US005566945A

United States Patent [19]

Saguccio

[11] Patent Number: 5,566,945

[45] Date of Patent: Oct. 22, 1996

[54] SYSTEM FOR PLAYING VARIETY OF GAMES

[76] Inventor: Esteban N. Saguccio, 200 N. Crickett Dr. (Apt. D), San Antonio, Tex. 78226-1648

[21] Appl. No.: 558,291

[22] Filed: Nov. 13, 1995

[51] Int. Cl.[6] ..... A63F 3/00

[52] U.S. Cl. ..... 273/284; 434/405

[58] Field of Search ..... 273/236, 274, 273/281, 282, 284, 155, 157, 289; 434/333, 348, 405

[56] References Cited

U.S. PATENT DOCUMENTS

| | | | |
|---|---|---|---|
| 3,097,435 | 7/1963 | Goldschmidt | 434/348 |
| 3,110,499 | 11/1963 | Boeskool | 434/348 X |
| 3,224,112 | 12/1965 | Hanson | 434/348 |
| 3,347,549 | 10/1967 | Jackson | 273/273 |
| 3,732,629 | 5/1973 | Spitzner | 434/348 X |
| 4,566,698 | 1/1986 | Sneden | 273/249 |
| 4,829,686 | 5/1989 | Endicott | 40/492 |
| 5,288,075 | 2/1994 | Kelley | 273/243 |
| 5,403,014 | 4/1995 | Anema et al. | 273/292 |

FOREIGN PATENT DOCUMENTS

| | | | |
|---|---|---|---|
| 1204906 | 9/1970 | United Kingdom | 434/348 |

*Primary Examiner*—William E. Stoll

[57] ABSTRACT

A square-shaped game card cooperating with a windowed and shuttered card holder is disclosed. The card is printed with plurality of sets of characters related to a variety of games or subjects. The card can be selectively positioned within the card holder by inserting the former into a playing pocket with any of its four sides inserted first. For every position of the card, a different and particular set of game characters is in registry with the windows.

5 Claims, 3 Drawing Sheets

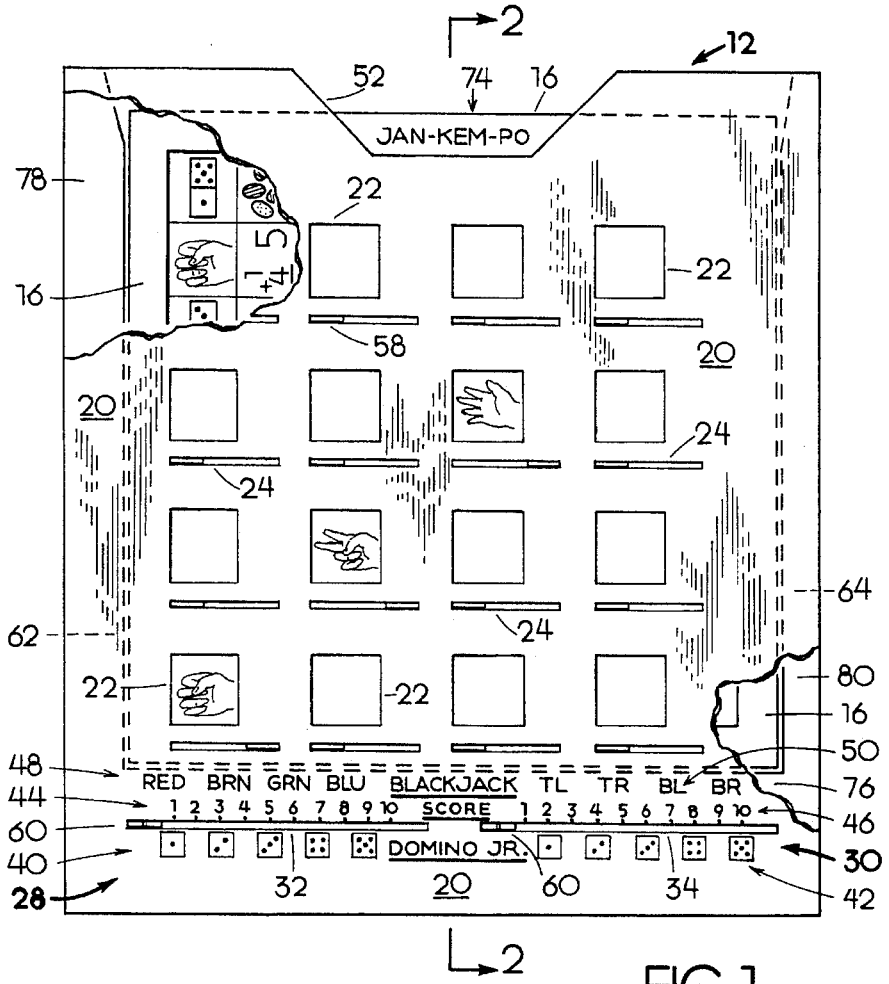
FIG. 1
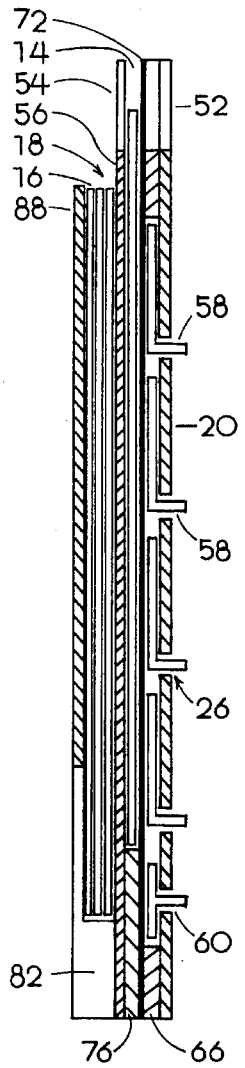
FIG. 2
FIG. 3
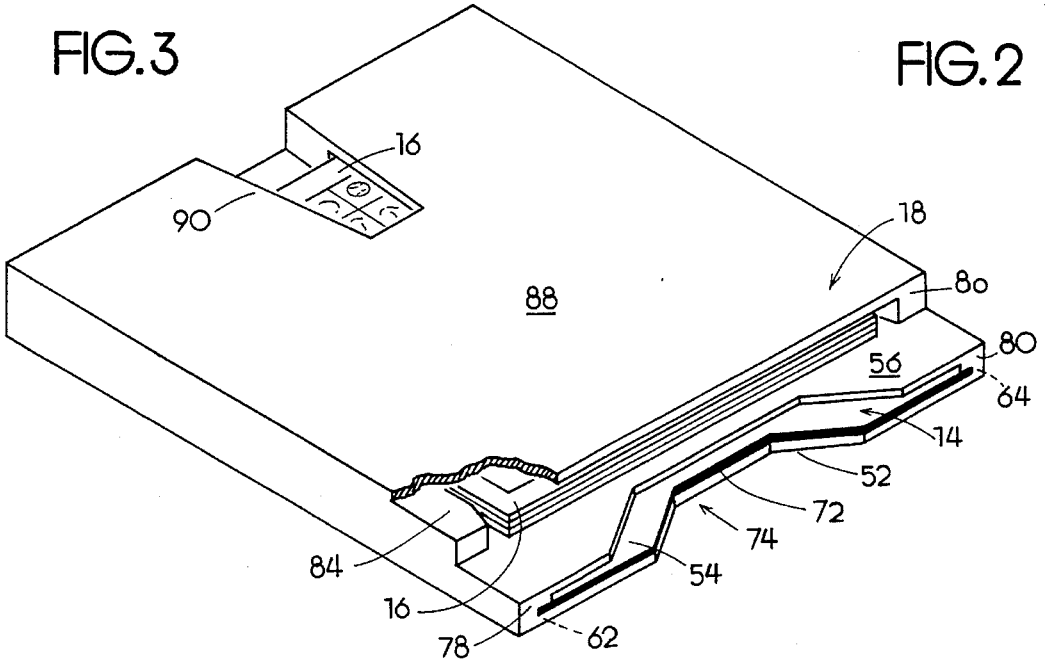

SYSTEM FOR PLAYING VARIETY OF GAMES

The present invention relates in general to games and competitive play. It can also be used as a learning material. It is the type that can be easily carried around and pertains particularly to a substantially small board game comprising a card with game-related characters, and a befitting card holder with windows and shutters to conceal or reveal the characters in registry therewith.

It is an object of the invention to provide a game card having many different games. This would greatly reduce the burden of handling many different cards and/or individualized game devices.

Another object is to provide a novel card holder wherein a plurality of game cards can be interchangeably inserted and selectively positioned thereinto.

Added objects and advantages will become apparent from the foregoing and ongoing specifications, drawings and appended claims.

The invention should make a good amusement device in public lobbies, indoor and outdoor parties, for vacationers on long driving and plane trips, luxury liners and many more. It can likewise be useful as a learning material in pre-schools. Its use can be extended also to include games for the more matured like the games Domino, Blackjack, Word Search and others. Some game rules and playing methods however, are modified to some extent in order to be adaptable into the system. This playing device is ideally for two players.

In a preferred embodiment, the game device includes plurality of square-shaped game cards, and a card holder with windows into which the cards are interchangeably lodged. Each face of a card is printed with four sets of game-related characters and every particular set is systematically arranged therein and which will be discussed subsequently in the specifications. The game characters for each set are equally spaced and they are in equal number of horizontal and vertical rows.

The front plate of the card holder has plurality of substantially square windows. These windows are equally spaced and are in equal number of horizontal and vertical rows comparable with the placement of a set of game characters. The system is so arranged such that when a game card is lodged in the card holder's playing pocket, the windows and a set of game characters are in registry with each other.

In the drawings:

FIG. 1 is a front elevational view of a card holder with a game card lodged in the playing pocket. Portion of the top-left corner of the front plate being broken away to show portion of the card being lodged. Three of the windows are in the open position and thus revealing the associated characters on the game card.

FIG. 2 is a slightly enlarged sectional view of the card holder, taken substantially along line 2—2 of FIG. 1.

FIG. 3 is a back perspective of the card holder in a somewhat upside-down position. A storage pocket, located at the back (see also FIG. 2), is provided for storing the game cards when they are not actually in use.

Figure 5:
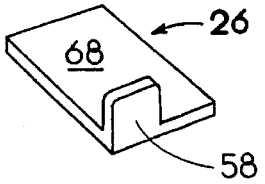
FIG. 5 shows an opaque window shutter, reciprocally slidable to conceal or reveal an associated game character printed on a game card.

Before going further into the details of the invention, it is to be understood that the term "characters" as used in this specification may mean to include figures, numbers, letters and other symbols printed on the game or learning cards. Also, the term "spot" may mean to include a single character or a group of characters printed on a game card and intended to be in registry with a single window when the card is fully inserted in a card holder's playing pocket.

Referring now to the drawings, FIG. 1 designates a generally flat card holder 12. It may be made of sheets of paperboard secured together as by adhesive. It may be made also of plastic or any other suitable material. The card holder 12 includes a playing pocket 14 for temporarily lodging-in a game card 16 selected for playing, and a storage pocket 18 (FIGS. 2 and 3) for storing the game cards.

Figure 6:
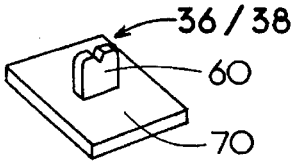
FIG. 6 is a multi-purpose sliding indicator for indicating a player's score, color or location of the characters being played, and what the "open-ends" are in a Domino game.
Figure 7:
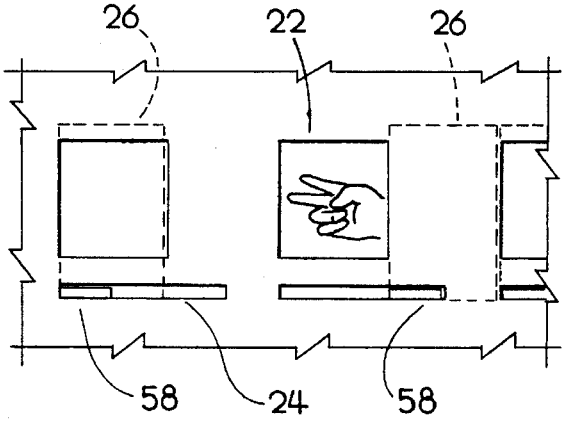
FIG. 7 is a fragment of the card holder shown in FIG. 1 showing two windows. The shutter for the window on the left is slided to the closed position as shown by broken lines; the shutter for the window on the right is slided to the open position as shown also by broken lines and thus revealing a game character associated with it.
Figure 4:
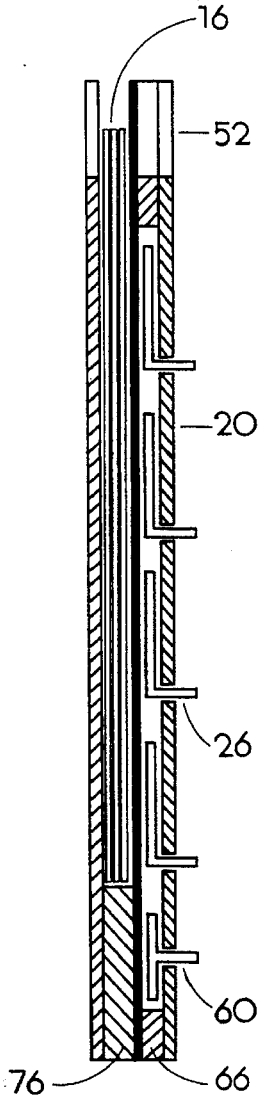
FIG. 4 is a vertical elevational view of another embodiment of a card holder. This embodiment is not provided with storage pocket on its back however, the playing pocket is made to accomodate about two to four cards, as shown.

The front plate 20 of the card holder has plurality of substantially square windows 22. Below each window is a horizontal slot 24 with length slightly exceeding the bottom side of the window, used to mount slidingly an associated shutter 26 thereof. Two multi-purpose indicators 28 and 30 are provided at the bottom of the front plate. Each has an extended slot 32 and 34 with sliders 36 and 38 (FIG. 6) which are movably supported to slide along said slots. Below each slot are series of domino character portions 40 and 42, used to indicate or remind the players what the two "open-ends" are in a Domino game. Whereby, when a good match is made, and thereby cancelling one of the open-ends, the slider adjacent the cancelled open-end is thus moved accordingly to indicate, a newly replacing open-end.

Adjacently above each slot 32 and 34 is marked with a series of progressively increasing numerals 44 and 46 used for indicating the players' scores. Higher above the left slot 32 are color designators 48 (for red, brown, green and blue), while higher above the right slot 34 are location designators 50 (for top-left, top-right, bottom-left and bottom-right). These later described designators are reminders as to the color and location of the characters being played, respectively.

At the top mid-portion of the front plate 20 is a recess 52 as shown. This recess, including a similar but longer recess 54 on the intermediate plate 56 (FIG. 3), provides for easy inserting or drawing of a game card. It also serves as a window to show the name of the game being played. The staggered arrangement of recesses 52 and 54 makes it more convenient to insert the game card from behind and thus during inserting, the players can avoid looking into the characters to be played.

As shown in FIG. 1, tab 58 of shutter 26 and tab 60 of sliders 36 and 38 are mounted to slide through their respective slots 32 and 34 on the front plate 20. Next behind the front plate are side spacers 62 and 64 and bottom spacer 66 with thickness slightly more than the thickness of the base portions 68 and 70 of the shutter and the slider. Attached suitably underlying the bottom and side spacers 66, 62 and 64 is a plexiglas or a relatively thick transparent plastic sheet 72, provided to movably confine the shutters and sliders, and also to provide protection for the game card from being scratched by the shutters when the former is inserted into the playing pocket 14.

The playing pocket has an open top end 74 and is defined between the plastic sheet 72 and the intermediate plate 56. At the lower end of the pocket, between the plastic sheet and the intermediate plate, is a bottom support 76 for supporting the card being played. Located on the sides, in co-planar with the bottom support, are side marginal guides 78 and 80 (FIG. 1) for guiding the game card during inserting. The thickness of the bottom ledge 82 and related side flanges 84 and 86 (FIG. 3) of the storage pocket 18 is determined by the anticipated number of game cards to be stored. A back plate 88 is suitably attached onto said bottom ledge and side flanges. An inverted modified V-cut 90 is provided for sliding a finger along when dislodging the stored game cards.

As shown in FIG. 1, the windows are spaced apart at least a dimension of the windows. The cluster of windows are lopsidedly positioned on the front plate 20 of the card holder 12. It will be noted that the right vertical row of windows are further from the right marginal guide 80 than the left vertical and bottom horizontal rows of windows respectively from the left marginal guide 78 and the bottom support 76. The necessity of this arrangement will be realized upon reading the discussions that follows.

Figure 8:
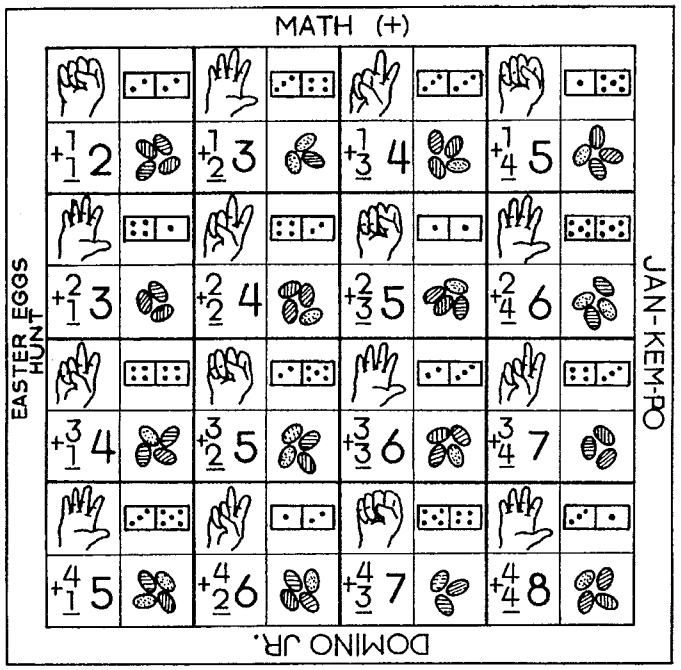
FIG. 8 shows one face of a game card. As shown, there is a variety of game-related characters printed therein.
Figure 9:
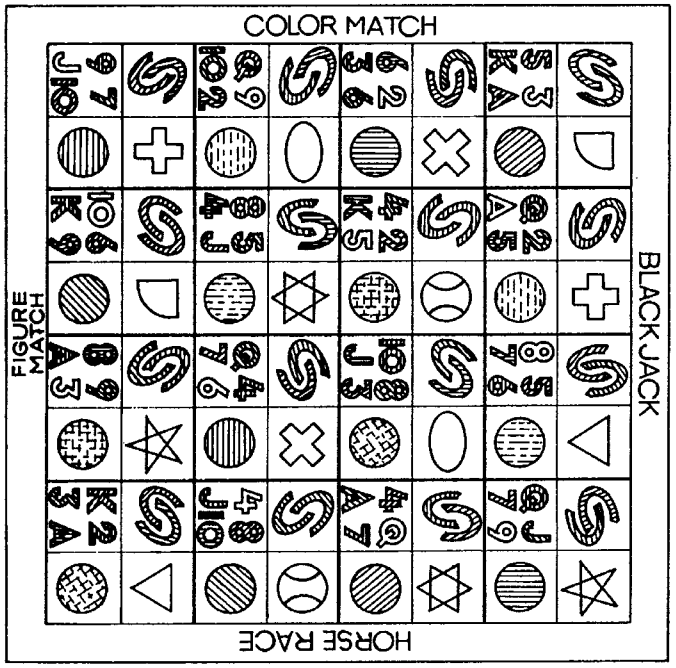
FIG. 9 shows the other face of the card of FIG. 8, or maybe one face of another game card.

A game card used in connection with the present invention is square in shape, and is shown in FIG. 8. There are four sets of game-related characters on this face of the game card. And for the sake of clarity concerning the placement of the game characters on the card, said card is arbitrarily partitioned into four rows of larger horizontal blocks and also four rows of vertical blocks. Each of the sixteen blocks formed encompasses four locations or "spots" and each of the four spots portrays a character or group of characters which is different from each other.

Still in FIG. 8, wherein the name of the game "JAN-KEM-PO" Is positioned on the top or away from the viewer, all the characters related to this particular game are situated on a similar location, like for example, on the left-bottom corner of every block. These characters are positioned such that they can be read or viewed the normal way by the players. When the card is fully inserted into the playing pocket, said "JAN-KEM-PO" characters and their associated windows are in registry with each other. Similarly, if another game or subject, like maybe a math lesson is desired for next playing, for example, the same card is pulled out of the playing pocket and then rotated so that the name of the game or subject "MATH (+)" is positioned on the top or away from the viewer. It will be noted likewise that all the characters related to this subject are on the bottom-left corner of every block and are also positioned to be easily read or viewed by the players. When the card is re-inserted into the playing pocket, said "MATH (+)" characters and their associated windows are also in registry with each other. The other sets of game characters on the card also fit the same explanation as those just described. With the above features and examples defined, it is apparent that a game card of the present invention can be rotated and be placed in any position desired, or any of its four sides inserted first.

It is to be understood that all matter herein disclosed or shown in the accompanying drawings is to be interpreted as illustrative and not in a limited sense. Numerous changes and modifications in the embodiment may be made without departing from the spirit and scope of the invention as defined in the appended claims:

I claim:

1. A system for playing a variety of games the combination comprising:

(a) a card holder having a front plate being formed with a plurality of windows and associated shutters mounted for slidably covering or exposing the windows, said windows being arranged in horizontal and vertical rows, evenly spaced and numerically equal, and a playing pocket for removably positioning a game card selected for playing, said pocket being defined between a transparent plastic sheet and an intermediate plate and spaced apart by a bottom support means and marginal guides on either sides thereof; and (b) a plurality of identical size, square shaped game cards having printed thereon a variety of sets of game-related characters, each particular set of said characters occupying a certain pattern on the card and arranged in horizontal and vertical rows, evenly spaced and numerically equal whereby, when said game card is lodged in said playing pocket, a particular set of game characters are in registry with said windows and thus appear therethrough when said shutters are in open position, and conceal said characters when said shutters are in the close position.

2. The system of claim 1 wherein means is provided to cause the set of game characters of a selected game to be in registry with said windows when said card is inserted into the playing pocket, said means including the right and left vertical rows of said windows being lopsidedly distanced from said side marginal guides thereof.

3. The system of claim 1 wherein said square shaped game card can be selectively positioned four-ways within said card holder by inserting same with any of its four sides entering first into said playing pocket, each of said positions exhibiting a different set of game characters thereof.

4. The system of claim 1 wherein each set of said game characters are positioned to be viewed or read easily through said windows when said game card is lodged in said playing pocket.

5. The system of claim 1 wherein said card holder further includes a storage pocket on the backside thereof, for storing the game cards when they are not actually in use.

* * * * *